US005810082A

United States Patent [19]

Jordan, Jr.

[11] Patent Number: 5,810,082

[45] Date of Patent: Sep. 22, 1998

[54] HYDROSTATICALLY ACTUATED PACKER

[75] Inventor: Henry Joe Jordan, Jr., Conroe, Tex.

[73] Assignee: Baker Hughes Incorporated, Houston, Tex.

[21] Appl. No.: 697,813

[22] Filed: Aug. 30, 1996

[51] Int. Cl.[6] ..... E21B 33/128

[52] U.S. Cl. ..... 166/120; 166/142; 166/151; 166/187; 166/387

[58] Field of Search ..... 166/120–122, 166/142, 151, 187, 188, 387

[56] References Cited

U.S. PATENT DOCUMENTS

| | | | |
|---|---|---|---|
| 4,216,827 | 8/1980 | Crowe | 166/120 |
| 4,285,400 | 8/1981 | Mullins | 166/187 X |
| 4,311,195 | 1/1982 | Mullins | 166/120 |
| 4,506,736 | 3/1985 | Evans . | |
| 4,834,175 | 5/1989 | Ross et al. . | |
| 5,046,557 | 9/1991 | Manderscheid . | |
| 5,113,939 | 5/1992 | Ross et al. . | |
| 5,146,983 | 9/1992 | Hromas et al. . | |
| 5,146,994 | 9/1992 | Pleasants et al. . | |

FOREIGN PATENT DOCUMENTS

| | | |
|---|---|---|
| 2294486 | 5/1996 | United Kingdom . |

*Primary Examiner*—Roger J. Schoeppel
*Attorney, Agent, or Firm*—Rosenblatt & Redano P.C.

[57] ABSTRACT

A packer is disclosed which uses applied pressure to set the slips and initiate a compressive force on the sealing elements. The compressive force applied to the sealing elements moves components above the sealing elements and allows the available hydrostatic pressure in the wellbore to create an opposing force on the sealing elements to ensure that they properly set. The sealing elements are mounted directly to the packer body, thus eliminating a leakpath from the fluid pressure application port which is located below the sealing elements on the packer body. Various lock rings hold the set of the packer to avoid the creation of boost forces on the sealing elements from applied or induced pressures from above or below the sealing elements. Movement of the body is not required to accomplish setting of this packer. In applications with low hydrostatic pressure, the annulus can be pressurized to assist in obtaining the necessary pack-off pressure. The hydrostatic pressure continues to be available as a pack-off force even when the pressure below the packing element depletes as the reservoir depletes. The packing element, which is mounted directly to the packer body, eliminates leakpaths behind it, while, at the same time, the packing element is set by opposed forces; i.e., hydraulic from below and hydrostatic from above.

19 Claims, 5 Drawing Sheets

HYDROSTATICALLY ACTUATED PACKER

FIELD OF THE INVENTION

The field of this invention relates to packers, particularly those that use available hydrostatic pressure in the wellbore to set.

BACKGROUND OF THE INVENTION

Packers previously in use could be set or actuated in various ways. Some packers are mechanically set using conventional or coiled tubing manipulation so as to place the force onto the slips and packing elements using either tension or compression. When threaded tubing is used, the packers could also be set mechanically by a rotational force. Another way to set packers is to use a wireline arrangement in conjunction with an electronic setting tool which uses an explosive power charge. The power charge creates the required relative movement in the setting tool which sets the packer and releases from the packer at the same time. Some packers set hydraulically using applied tubing pressure, either through a hydraulic setting tool or through hydraulic chambers mounted integrally in the tool.

Some of these designs required the movement of a mandrel in order to effectuate setting. This created difficulties in using such packers against a stop and obtain full pack off. One example of such a stop is a liner top. In hydraulically actuated designs, the hole through the body presented a potential leakpath around the elements which has, in turn, necessitated that prior designs have the access hole through the body located below the packing element in order to eliminate a potential leakpath across the element system. For those designs that desired to employ the hydrostatic pressure in wellhead, the placement of the hydrostatic chamber was also below the sealing elements so as to prevent potential problems of fluid loss behind the sealing elements in the set position. However, such placement created difficulties in using the available hydrostatic forces in the wellbore to accomplish setting of the packer. In some cases, that hydrostatic pressure below the element diminished as the reservoir depleted or as the well produced lighter fluids.

The upshot of the present invention is to address many shortcomings of the prior designs. It provides a design where packer body movement is not required to set the packer. There are no boost forces applied to the sealing elements once set which would tend to derate the sealing elements. The leakpaths behind the sealing elements have been eliminated by placing the sealing elements directly on the packer body, while, at the same time, employing wellhead hydrostatic pressure against the chamber that is located above the sealing elements. These advantages alone, or in combination, provide an improved design for use in permanent or retrievable packers. The design also brings closer together the slips and sealing element to desirably aid in centralizing the packing element system.

SUMMARY OF THE INVENTION

A packer is disclosed which uses applied pressure to set the slips and initiate a compressive force on the sealing elements. The compressive force applied to the sealing elements moves components above the sealing elements and allows the available hydrostatic pressure in the wellbore to create an opposing force on the sealing elements to ensure that they properly set. The sealing elements are mounted directly to the packer body, thus eliminating a leakpath from the fluid pressure application port which is located below the sealing elements on the packer body. Various lock rings hold the set of the packer to avoid the creation of boost forces on the sealing elements from applied or induced pressures from above or below the sealing elements. Movement of the body is not required to accomplish setting of this packer. In applications with low hydrostatic pressure, the annulus can be pressurized to assist in obtaining the necessary pack-off pressure. The hydrostatic pressure continues to be available as a pack-off force even when the pressure below the packing element depletes as the reservoir depletes. The packing element, which is mounted directly to the packer body, eliminates leakpaths behind it, while, at the same time, the packing element is set by opposed forces; i.e., hydraulic from below and hydrostatic from above.

DETAILED DESCRIPTION OF THE PREFERRED EMBODIMENT

Figure 1A:
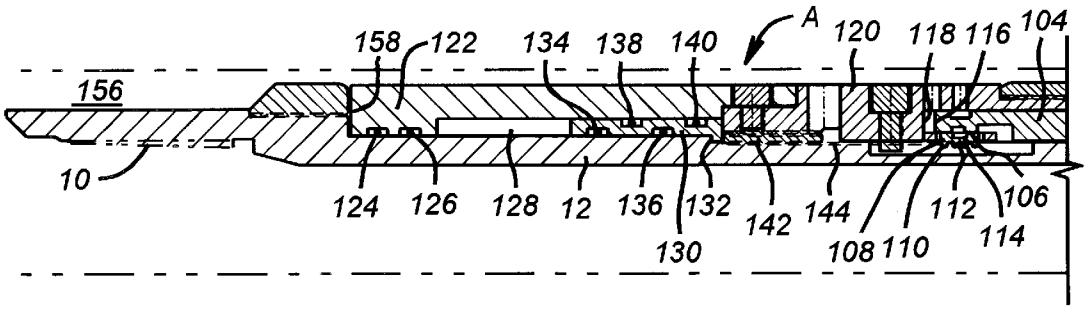
FIGS. 1*a*–1*e* are the sectional elevational view of the tool in the run-in position.

As shown in FIG. 1*a*, the apparatus A has a thread 10 on a mandrel 12 for proper positioning of the apparatus A in the wellbore. The mandrel 12 extends from FIG. 1*a* through FIG. 1*e*. At the lower end of the mandrel 12 is bottom sub 14 connected to mandrel 12 at thread 16. Seal 18 seals between the mandrel 12 and the bottom sub 14. Seal 20 seals between the bottom sub 14 and outer body member 22. The bottom sub 14 has a series of collet fingers 24, which have a thread 26 facing a mating thread 28 on outer body member 22. Ring 30, which is held by shear pin 32, holds the threads 26 and 28 together.

Figure 1C:
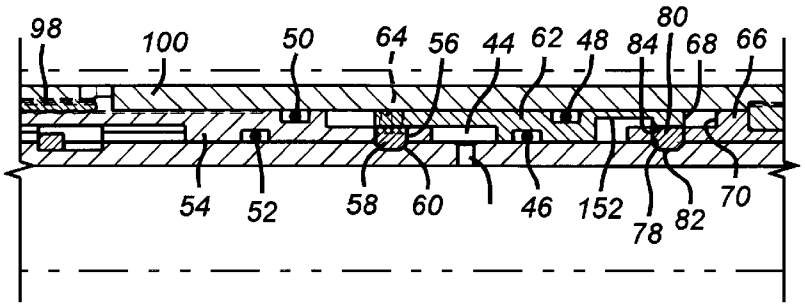
Figure 3C:
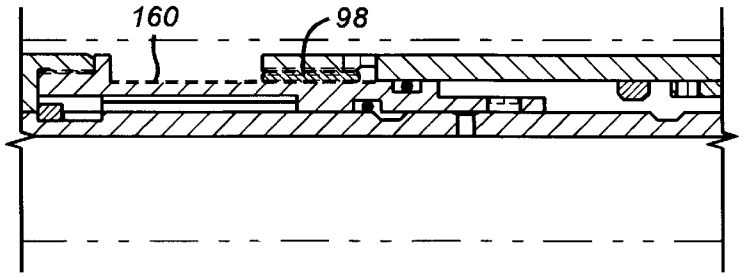
Figure 1D:
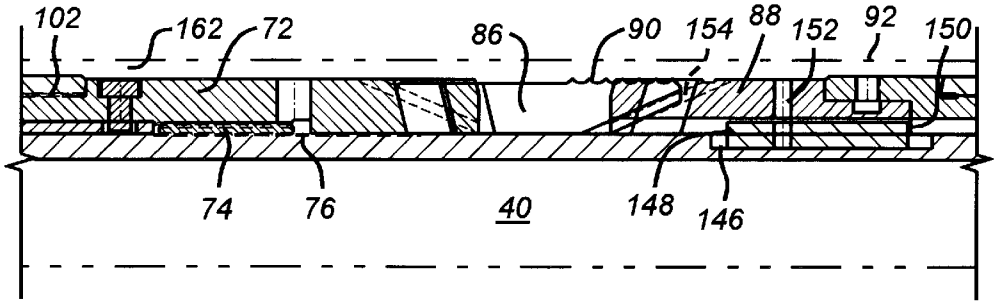

The outer body member 22 has a lower end 34 which can accommodate further downhole equipment, including a ball seat 36 which can accommodate a ball 38 dropped from the surface to obstruct the central flowpath 40 for the purposes of building pressure into lateral port 42. Port 42 is located through the mandrel, as shown in FIG. 1*c*. It allows fluid communication between the central flowpath 40 and chamber 44. Chamber 44 is sealed by seals 46, 48, 50, and 52. Seals 50 and 52 are carried by element-compressing piston 54. Piston 54 has a window 56 through which extends dog 58 which, in the run-in position shown in FIG. 1*c*, also extends into groove 60 in mandrel 12. Thus, with the dog 58 trapped in groove 60, the piston 54 cannot move. Seals 48 and 46 are carried by the slip piston 62. Piston 62 is connected to piston 54 by a shear pin 64, which holds their relative position during run-in. Shear pin 64 is shown in dashed lines in FIG. 1*c* because it is rotationally offset from dog 58. Piston 62 ultimately bears on sleeve 66, although in the run-in position there is a gap between the lower end 68 of the piston 62 and shoulder 70 of sleeve 66. Sleeve 66 abuts cone 72, as well as lock ring 74. Lock ring 72 rides on teeth 76 on mandrel 12 such that advancement of the cone 72 is locked into mandrel 12 by lock ring 74, as will be described below.

The sleeve 66 has a window 78 through which extends dog 80. Dog 80 also extends into groove 82 in mandrel 12. In the run-in position, dog 80 is trapped by slip piston 62 by virtue of contact of dog 80 with raised surface 84. Accordingly, until there is movement of piston 62, sleeve 66 is locked to mandrel 12 by virtue of dog 80.

Cone 72 pushes on slips 86 which ride on guide 88 so that the wickers 90 can be advanced toward the casing 92. The slips 86 are retained in the guide 88 in a well-known manner for outward advancement of the slips 86.

The piston 54 bears on ring 94 which abuts the sealing element system 96. The sealing element system 96,in this particular instance includes a series of elements which are mounted directly onto the mandrel 12 without any sleeves underneath. This design detail is significant in that a leak-path is eliminated due to the elimination of sleeves underneath the sealing element system 96. Any ultimate movement by the piston 54 in response to applied pressure port 42 is locked in by virtue of lock ring 98. Lock ring 98 is supported by sleeve 100, which at one end is connected to cone 72 at thread 102.

Figure 2A:
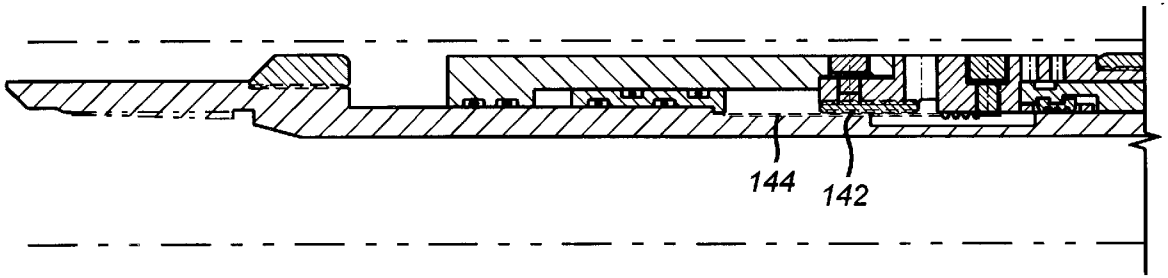
FIGS. 2*a*–2*e* are the view of FIGS. 1*a*–1*e* showing the tool in the set position.
Figure 1B:
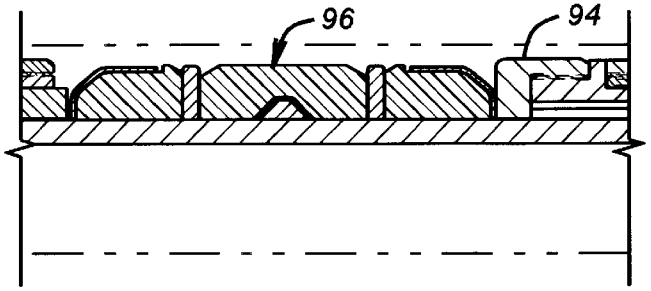
Figure 2B:
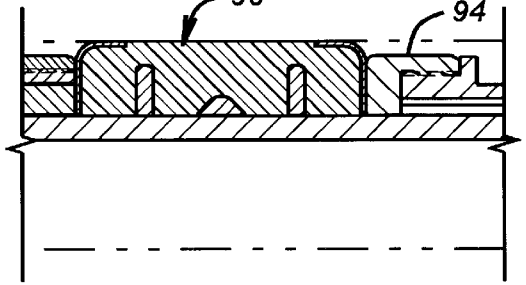

The sealing element system 96 abuts sleeve 104, as shown in FIG. 1*a*. In the run-in position, sleeve 104 has a surface 106 which abuts dog 108. Dog 108 has a series of teeth 110 which extend into a mating pattern 112 in mandrel 12. Dog 108 has a recess 114. When surface 106 on sleeve 104 aligns with recess 114, the dog 108 is no longer trapped against the mandrel 12. This position is seen in FIG. 2*a*. There is an initial clearance between surface 116 on sleeve 104 and surface 118 on ring 120. This clearance is closed as seen by comparing FIG. 1*a* to FIG. 2*a*. Piston 122 is mounted over the mandrel 12, with seals 124 and 126 in between. A chamber 128 is defined between the piston 122 and mandrel 12. A ring 130 has an interior shoulder 132 which prevents its upward advancement with respect to the mandrel 12. Ring 130 houses seals 134 and 136 against the mandrel 12 and seals 138 and 140 against the piston 122. The piston 122 bears against the ring 120. These two members move downwardly in tandem, along with lock ring 142. Lock ring 142 moves along teeth 144 on mandrel 12 so that the downward movement of piston 122 is retained by lock ring 142, as shown in FIG. 2*a*.

The mandrel 12 has a longitudinal recess 146 (see FIG. 1*d*) within which is a key 148 which extends into a recess 150 in guide 88 to rotationally lock guide 88 to the mandrel 12. An optional shear pin 152 extends through guide 88 and into mandrel 12. Shear pin 152 is rotationally offset from key 148.

Figure 2C:
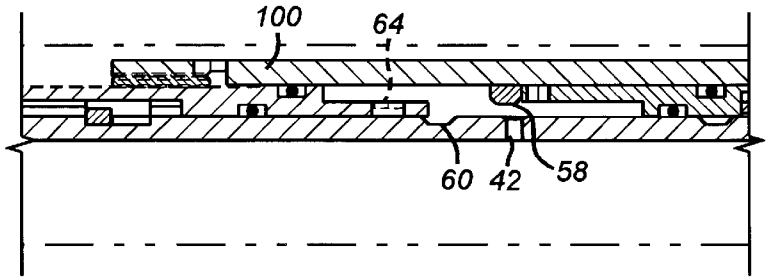
Figure 2D:
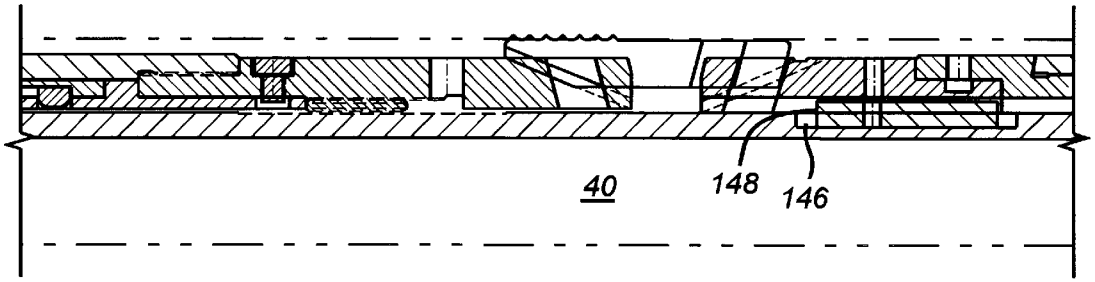
Figure 3D:
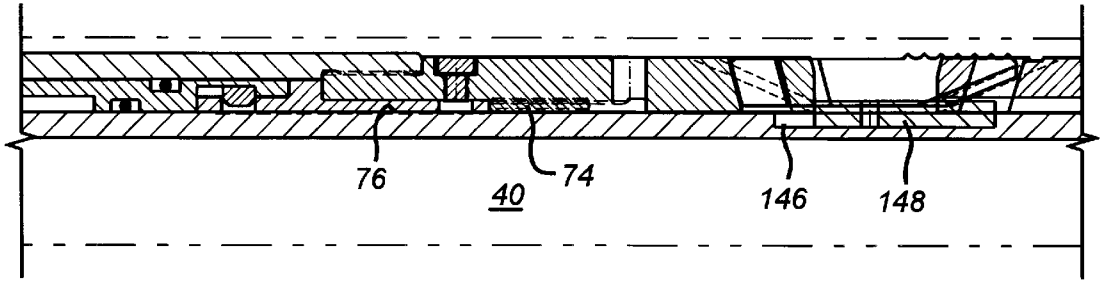
Figure 1E:
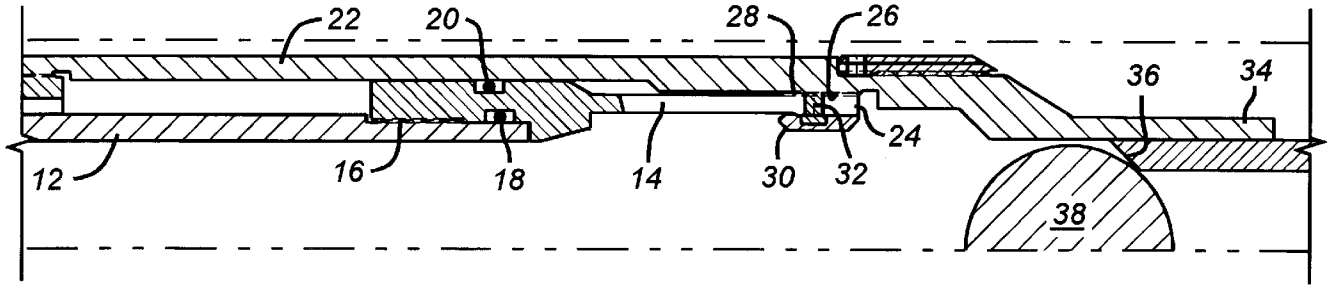
Figure 2E:
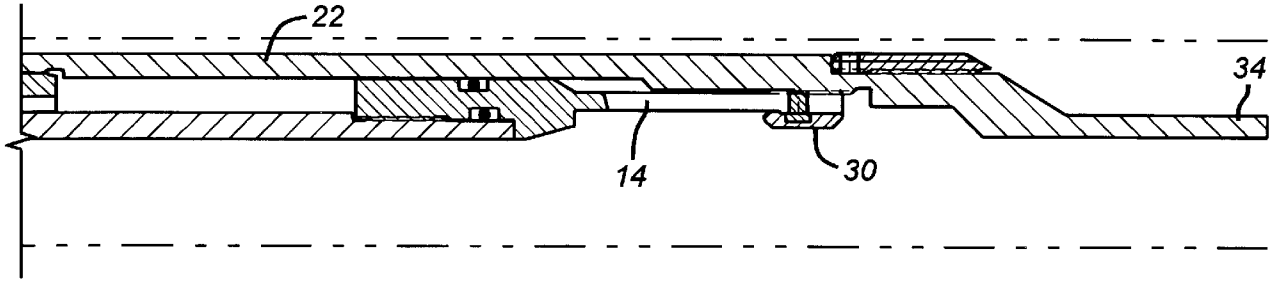
Figure 3E:
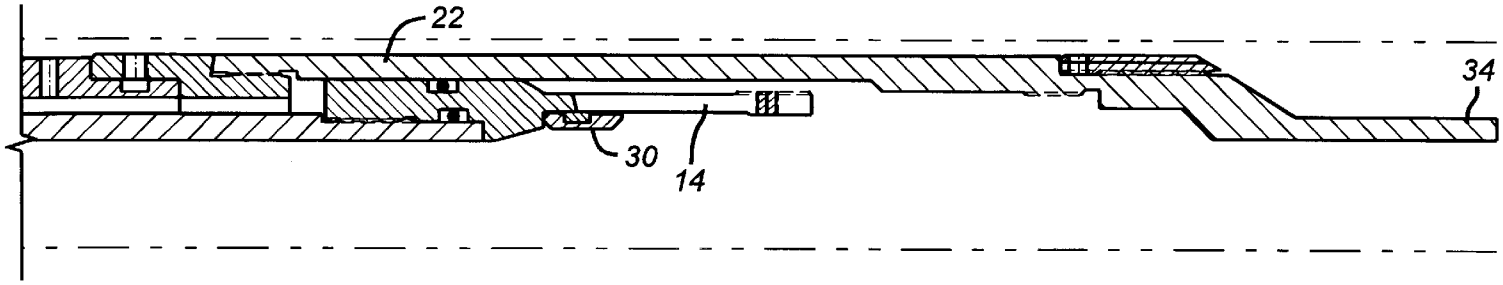

The principal components now having been described, the operation of the apparatus A will be explained in more detail. When the apparatus A is in position in the location desired, a ball 38 is dropped onto ball seat 36 to close off flowpath 40 below lateral port 42. Other techniques may be employed to allow internal pressure buildup in the apparatus A without departing from the spirit of the invention. Pressure is applied to chamber 44 through port 42. After breaking shear pin 64, slip piston 62 is displaced downwardly until recessed surface 153 moves into alignment with dog 80, which allows dog 80 to shift radially outwardly out of groove 82 in the mandrel 12. Accordingly, upon sufficient shifting of the piston 62, the sleeve 66 is now free to move as lower end 68 hits shoulder 70. Once that occurs, sleeve 66 moves cone 72 against slips 86. Slips 86 ride up tapered surface 154 on guide 88, which is, itself, held stationary because it in turn is connected to outer body member 22 which, through the collets 24, is retained back around to the mandrel 12 which is supported from the surface. Accordingly, movement of piston 62 frees up sleeve 66 to move against cone 72, bringing cone 72 closer to guide 88, which is held stationary, thereby urging the slips 86 to move radially outwardly until the wickers 90 bite into the casing 92. This position is illustrated in FIG. 2*d*.

Pressure buildup in chamber 44 results in the breaking of shear pin 64 so as to permit the movement of piston 62, as previously described. Movement of piston 62 takes away the support of dog 58, allowing it come out of groove 60, which in turn unlocks the piston 54 and allows it to move toward the sealing element system 96. Thus, at the same time that the sleeve 66 is liberated to move toward the slips 86, the piston 54 becomes liberated to move toward the sealing element system 96. The sealing element system 96 begins to be compressed by upward movement of ring 94. As a result of such movement, the sealing element system 96 displaces sleeve 104 to bring into alignment surface 106 with recess 114 on dog 108. As a result, dog 108 becomes free of the mandrel 12, as shown in FIG. 2a. Sleeve 104 is then displaced in the opposite direction because the liberating of dog 108 allows hydrostatic pressures in the annular space 156 to displace piston 122 against ring 120. The movement of dog 108 allows ring 120 to move relatively to mandrel 12. Up until that time, ring 120 and piston 122 were locked by dog 108 against hydrostatic pressure acting on surface 158 of piston 122. The pressure trapped in chamber 128 is at atmospheric or some other low pressure. Thus, when ring 120 is no longer locked to the mandrel 12, a pressure imbalance on piston 122 drives it downwardly toward the sealing element system 96. If sufficient hydrostatic pressure is not available, it can be increased by applied annulus pressure at the surface. As the piston 122 moves downwardly, the lock ring 142 moves with ring 120, thus trapping ring 120 and piston 122 in the position shown in FIG. 2*a* via the interaction with teeth 144. The apparatus A is now fully set.

Figure 3A:
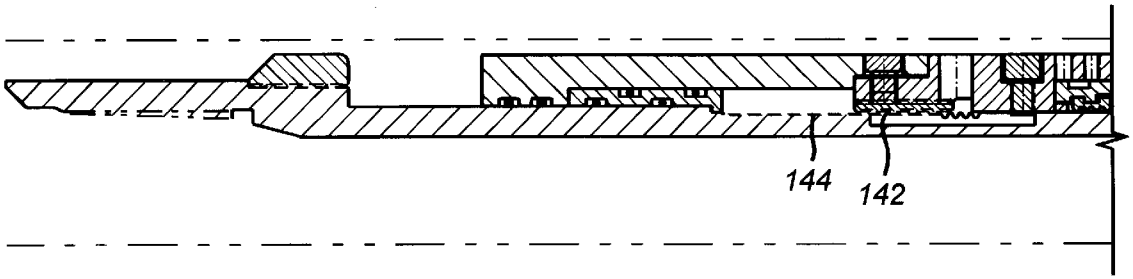
FIGS. 3*a*–3*e* are the view of the tool shown in FIGS. 2*a*–2*e* in the released position.
Figure 3B:
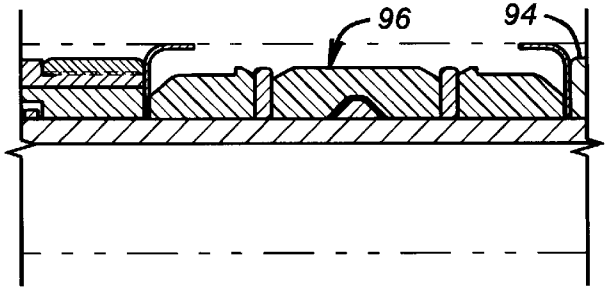

In order to release, a release tool of a type known in the art is run in the wellbore through passage 40 to engage ring 30. Shear pin 32 is snapped by the release tool, which in turn pulls up ring 30 to release the collet fingers 24 from their grip on thread 28. Thereafter, with the ring 30 displaced, the outer body member 22 can move downwardly with respect to the mandrel 12 and the collet fingers 24 on the bottom sub 14. This downward movement results in breakage of shear pin 152 as guide 88 moves downwardly, pulling the slips 86 downwardly away from casing 92 along the sloping guide surface 154. The sealing element system 96 is then allowed to stretch out, as indicated in FIG. 3*b*, since the cone 72 is now free to move downwardly, as indicated in FIG. 3*b*. It should be noted that to effectuate the release, the lock ring 74 has moved further downwardly along teeth 76 to the point where it is past the end of teeth 76. Lock ring 98 has moved further downwardly with respect to teeth 160.

It should be noted that the apparatus of the present invention provides for hydraulic pressure acting on piston 54 to push the sealing element system 96 from below, while the hydrostatic pressure in the annulus 156 pushes downwardly on the sealing element system 96 from above. Since the annular space 156 above the sealing element system 96 is generally full of liquid of a known weight, the hydrostatic forces from above the sealing element system 96 in apparatus A of the present invention are always available. This is to be contrasted with prior designs that used the piston acting against an atmospheric chamber disposed below the sealing element system 96. Such designs employ the hydrostatic pressure available in the annular space 162, which is below the sealing element system 96. Those prior designs that depended on the pressure in the annular space 162, or within the tubing such as within passage 40, were prone to fluctuations, for example, in situations where the well began to produce gas. It should also be noted that the hydraulic pressure access port 42 is located below the sealing element system 96. Yet, because the sealing element system 96 is mounted directly to the mandrel 12, there is no leakpath to the piston 122 which is disposed above the sealing element system 96. The operation of the apparatus A clearly indicates that the apparatus A can be set by an initial hydraulic pressure which triggers the available hydrostatic pressure to squeeze the sealing element system 96 in opposed directions for obtaining a good seal. Relative movements are not required and the mandrel 12 remains stationary during set Even if there is a failure in O-rings or seals 50, 52, 48, or 46, the result is flow communication between the passage 40 and the annular space 162 below the sealing element system 96. Since in many applications those two pressures are identical, any leakpath which could form is of less consequence than allowing the tubing pressure, such as that present in passage 40, to communicate with the annular space 156 above the sealing element system 96.

The hydrostatic pressure in the annular space 156 is always available and, thus, presents an advantage in the apparatus A when compared to prior designs which relied on the pressure in the tubing or the annular space 162 which could be depleted as the reservoir pressure depletes. The sealing element system 96 does not need to be derated because of an elimination of any boosting pressure on the sealing element system 96 as a result of applied or induced forces from changing conditions in the wellbore. For example, if additional force is applied from uphole against the mandrel 12 if, for example, the tubing is of a smaller diameter than the mandrel 12 diameter adjacent the thread 10, such forces are directed right into the slips 86 through the mandrel 12, which is in turn connected through the collets 24 back into outer body member 22 which is connected to the slips 86 through guide 88. The same result is obtained if the forces are induced from a downhole direction going uphole.

In situations where the apparatus A is to be secured in fairly shallow wells where a limited amount of hydrostatic pressure is available in annular space 156, the pressure in the annular space 156 can be boosted from the surface, which results in-an increased pack-off force applied to surface 158 when piston 122 becomes free to move. Since the mandrel 12 does not need to be moved in order to set the apparatus A, it can be set against the liner top or a sump packer and obtain full pack off. The technique, as illustrated, can be employed on permanent and retrievable packers. The distance between the sealing element system 96 and the slips 86 is also minimized to aid in centralizing the sealing element system 96.

Since after set additional forces are bypassing the sealing element system 96 and are transmitted into the slips 86, the rubber pressure on the sealing element system is not increased. Therefore, there is no limitation on the pressure rating of the apparatus due to such boost pressures. The use of available hydrostatic pressure in annular space 156 allows the use of lower tubing pressures to be employed, as well as making possible the compaction of the sealing element system 96 from both directions.

The foregoing disclosure and description of the invention are illustrative and explanatory thereof, and various changes in the size, shape and materials, as well as in the details of the illustrated construction, may be made without departing from the spirit of the invention.

I claim:

1. A packer, comprising:

a mandrel having an uphole and a downhole end;

a sealing element on said mandrel movable between a retracted and an expanded position;

a gripping mechanism on said mandrel;

a hydrostatically operated actuating mechanism comprising an actuating piston exposed to hydrostatic pressure on one side and a lower pressure on an opposing side, said actuating piston selectively releasable to allow said hydrostatic pressure to apply a force to said sealing element to move it to its expanded position, said actuating piston mounted between said sealing element and said uphole end of said mandrel such that a leak path between said sealing element and said mandrel is eliminated.

2. The packer of claim 1, further comprising:

a lock assembly for said actuating mechanism, said lock assembly responsive to applied pressure.

3. The packer of claim 2, wherein:

said lock assembly is actuated by pressure applied internally to said mandrel.

4. The packer of claim 3, wherein:

said lock assembly is mounted outside said mandrel and applied pressure communicates with said lock assembly through an access passage located between said sealing element and said downhole end of said mandrel.

5. The packer of claim 4, wherein:

upon actuation of said lock assembly said sealing element is squeezed in opposed directions.

6. The packer of claim 5, further comprising:

a first piston as a part of said lock assembly movable responsive to applied pressure to exert force on said sealing element toward said uphole end of said mandrel;

said first piston displacing said sealing element whereupon said hydrostatically operated actuating mechanism becomes free to move in a direction where an opposing force to said piston is hydrostatically applied to said sealing element from said actuating mechanism.

7. The packer of claim 6, wherein:

said sealing element and said gripping mechanism can be set without movement of said mandrel.

8. The packer of claim 7, wherein:

said sealing element when set is isolated from forces applied to said mandrel in either an uphole or a downhole direction by virtue of transmission of said forces through said mandrel to said gripping mechanism.

9. The packer of claim 6, further comprising:

a plurality of pistons comprising a second piston responsive to applied pressure to urge said gripping mechanism from a retracted to an extended position;

said first piston is freed to move against said sealing element responsive to said applied pressure after said second piston moves said gripping member.

10. The packer of claim 9, wherein:

said sealing element responsive to movement of said first piston unlocks said actuating piston which is hydrostatically actuated to squeeze said sealing element against the force of said first piston.

11. The packer of claim 10, wherein:

said actuating piston defines a low-pressure chamber with said mandrel such that when said actuating piston is unlocked by movement of said sealing element, hydrostatic forces adjacent said uphole end of said mandrel act on said actuating piston, overcoming any opposing pressure on said actuating piston in said chamber.

12. The packer of claim 1, wherein:

said sealing element and said gripping mechanism can be set without movement of said mandrel.

13. The packer of claim 12, wherein:

said sealing element when set is isolated from forces applied to said mandrel in either an uphole or a downhole direction by virtue of transmission of said forces through said mandrel to said gripping mechanism.

14. The packer of claim 13, further comprising:

a plurality of pistons comprising a gripping mechanism piston responsive to applied pressure to urge said gripping mechanism from a retracted to an extended position;

a sealing element piston which is allowed to move against said sealing element responsive to said applied pressure after said gripping mechanism piston moves said gripping member.

15. The packer of claim 1, wherein:

said sealing element when set is isolated from forces applied to said mandrel in either an uphole or a downhole direction by virtue of transmission of said forces through said mandrel to said gripping mechanism.

16. The packer of claim 1, further comprising:

a plurality of pistons comprising a gripping mechanism piston responsive to applied pressure to urge said gripping mechanism from a retracted to an extended position;

a sealing element piston which is allowed to move against said sealing element responsive to said applied pressure after said gripping mechanism piston moves said gripping member.

17. The packer of claim 16, wherein:

said sealing element responsive to movement of said sealing element piston unlocks said actuating piston to squeeze said sealing element against the force of said sealing element piston.

18. The packer of claim 17, wherein:

said actuating piston defines a low-pressure chamber with said mandrel such that when said actuating piston is unlocked by movement of said sealing element, hydrostatic forces adjacent said uphole end of said mandrel act on said actuating piston, overcoming any opposing pressure in said chamber.

19. The packer of claim 1, wherein:

said sealing element and said gripping mechanism can be set without movement of said mandrel.

* * * * *